US010609468B2

(12) United States Patent
Farahanisamani et al.

(10) Patent No.: US 10,609,468 B2
(45) Date of Patent: Mar. 31, 2020

(54) ACTIVE NOISE CANCELLATION SYSTEM FOR HEADPHONE

(71) Applicant: AVAtronics Sarl, Lausanne (CH)

(72) Inventors: Amirhooshang Farahanisamani, Lausanne (CH); Jeyran Hezaveh, Lausanne (CH); Ali Talebi, Dearborn, MI (US)

(73) Assignee: AVATRONICS SARL, Lausanne (CH)

( * ) Notice: Subject to any disclaimer, the term of this patent is extended or adjusted under 35 U.S.C. 154(b) by 0 days.

(21) Appl. No.: 16/333,973

(22) PCT Filed: Sep. 14, 2017

(86) PCT No.: PCT/EP2017/073212
§ 371 (c)(1),
(2) Date: Mar. 15, 2019

(87) PCT Pub. No.: WO2018/050787
PCT Pub. Date: Mar. 22, 2018

(65) Prior Publication Data

US 2019/0268687 A1 Aug. 29, 2019

Related U.S. Application Data

(60) Provisional application No. 62/395,447, filed on Sep. 16, 2016.

(51) Int. Cl.
*H04R 1/10* (2006.01)
*H04R 3/00* (2006.01)
*G10K 11/178* (2006.01)

(52) U.S. Cl.
CPC ..... *H04R 1/1083* (2013.01); *G10K 11/17853* (2018.01); *G10K 11/17873* (2018.01);
(Continued)

(58) Field of Classification Search
CPC ..... H04R 1/10; H04R 1/1083; H04R 3/00; H04R 2227/001; H04R 2410/01;
(Continued)

(56) References Cited

U.S. PATENT DOCUMENTS 5,377,276 A * 12/1994 Terai ..... G10K 11/178 381/71.11
2005/0286714 A1* 12/2005 Tokuda ..... H04B 3/23 379/406.05

(Continued)

FOREIGN PATENT DOCUMENTS

| | | | |
|---|---|---|---|
| EP | 2 148 528 | A1 | 1/2010 |
| JP | 2008 199594 | A | 8/2008 |
| WO | 2016/054186 | A1 | 4/2016 |
| WO | 2018/050787 | A1 | 3/2018 |

OTHER PUBLICATIONS

European Patent Office, International Search Report and Written Opinion for Patent Cooperation Treaty Application No. PCT/EP2017/073212, dated Jan. 4, 2018.

*Primary Examiner* — Thang V Tran
(74) *Attorney, Agent, or Firm* — Socal IP Law Group LLP; Angelo Gaz

(57) ABSTRACT

An active noise cancellation system comprising an active noise cancellation circuit connected to a microphone arranged to sense environmental noise, the active noise cancellation circuit comprising: —an analog-to-digital converter (ADC) arranged to convert the sensed environmental noise to a digital environmental noise signal, —a prediction filter configured for predicting a plurality D of inverted digital environmental noise samples and generating a digital inverted environmental noise signal, —a digital-to-analog converter (DAC) to convert the digital inverted environmental noise signal to an analog inverted environmental noise signal for cancelling the environmental noise.

21 Claims, 3 Drawing Sheets

(52) U.S. Cl.
CPC ..... *G10K 2210/1081* (2013.01); *G10K 2210/3028* (2013.01); *H04R 2227/001* (2013.01); *H04R 2410/05* (2013.01)

(58) Field of Classification Search
CPC ..... H04R 2410/05; H04R 2460/01; G10K 11/16; G10K 11/178; G10K 11/17853; G10K 11/18773; G10K 2210/00; G10K 2210/108; G10K 2210/1081; G10K 2210/3028
See application file for complete search history.

(56) References Cited

U.S. PATENT DOCUMENTS

| | | | | |
|---|---|---|---|---|
| 2008/0069368 | A1 | 3/2008 | Shumard | |
| 2009/0196445 | A1* | 8/2009 | Elmedyb | H04R 25/453 381/318 |
| 2009/0214054 | A1 | 8/2009 | Fujii | |
| 2009/0310793 | A1* | 12/2009 | Ohkuri | G10L 21/0208 381/58 |
| 2009/0323976 | A1* | 12/2009 | Asada | G10K 11/178 381/71.1 |
| 2011/0311075 | A1* | 12/2011 | Elmedyb | H04R 25/353 381/94.2 |
| 2012/0020485 | A1 | 1/2012 | Visser et al. | |
| 2017/0299425 | A1* | 10/2017 | Barjatia | G01H 7/00 |
| 2018/0182371 | A1* | 6/2018 | Thormundsson | G10K 11/17833 |

* cited by examiner

ACTIVE NOISE CANCELLATION SYSTEM FOR HEADPHONE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the patent and trademark office patent files or records, but otherwise reserves all copyright and trade dress rights whatsoever.

RELATED APPLICATION INFORMATION

This application claims priority to International PCT Application No. PCT/EP2017/073212, with an international filing date of Sep. 14, 2017, entitled "ACTIVE NOISE CANCELLATION SYSTEM FOR HEADPHONE," which claims priority to U.S. Provisional Patent Application No. 62/395,447 filed Sep. 16, 2016, the disclosures and figures of which are incorporated by reference as if set forth herein in their entirety.

The present invention relates to an active noise cancellation system, in particular for headphones and earphones, and to headphones and earphones with active noise cancellation systems.

In conventional headphones with active noise cancellation, a microphone inside the headphone detects external environmental noise which is then processed to generate an inverted signal that cancels the environmental noise in the audio signal generated for the headphone wearer. The measured noise signal is used to generate a feedback signal that is processed through an amplifier to adjust the level and then inverted and applied to a speaker of the headphone for cancellation of the noise signal. Filtering is applied to preserve the intended audio signal. Most active noise cancellation techniques employed today are analogue with variations in implementation schemes, filters, and the placing of the microphone and speaker.

More recently digital noise cancellation techniques have been developed. Conventional digital noise cancellation techniques are primarily based on sub-band filtering and generation of the main frequency tones and their harmonics to cancel a large portion of the environmental noise. These techniques provide reasonably effective noise cancellation for a large part of the typical noise to which users are subject to in practice. However, existing noise cancellation techniques have major limitations on the audio signal bandwidth that they can handle, the quality of the intended audio signal to be played for the user, and the reduction level of the noise, whereby the best-in-class products typically cannot reduce the noise level more than 10 dB.

It would be desirable to improve the performance of active noise cancellation without compromise in the audio quality of the intended sound generated for the user.

In view of the foregoing, it is an object of the present invention to provide an active noise cancellation system that is effective in cancelling environmental noise while preserving a high quality audio signal.

Another object of the invention is to provide a headphone with an active noise cancellation system that is effective in cancelling environmental noise and that has minimal or no effect on the quality of the audio signal intended for the wearer.

It is advantageous to provide an active noise cancellation system that is easy to implement and that is cost effective.

Objects of this invention have been achieved by providing the active noise cancellation system according to claim 1, the headphone according to claim 6 and the method of generating a headphone audio signal according to claim 8.

The term "headphone" as used in the present description and claims is intended to encompass any electrically powered mobile sound reproducing device that is worn by a person over, close to, or in a person's ear or pair of ears. For instance one earphone or a pair of earphones are understood herein as falling within the meaning of the term "headphone".

Disclosed herein is an active noise cancellation system comprising an active noise cancellation circuit connected to a microphone arranged to sense environmental noise, the active noise cancellation circuit comprising:

- an analog-to-digital converter (ADC) arranged to convert the sensed environmental noise to a digital environmental noise signal,
- a prediction filter configured for predicting a plurality D of inverted digital environmental noise samples and generating a digital inverted environmental noise signal,
- a digital-to-analog converter (DAC) to convert the digital inverted environmental noise signal to an analog inverted environmental noise signal for cancelling the environmental noise.

In an embodiment, the active noise cancellation circuit comprises a casing frequency response filter arranged in the digital signal path before or after the prediction filter, to compensate the effects of location of the microphone on the sensed environmental noise.

In an embodiment, the active noise cancellation circuit comprises a summing circuit arranged to add an audio signal intended for playing to a user to the digital or analog inverted environmental noise signal.

In an embodiment, the active noise cancellation circuit comprises an amplifier to adjust the gain of the summed audio and inverted environmental noise signals.

In an embodiment, the ADC and DAC work at a clock frequency fs having a total latency of less than 1 μs.

Also disclosed herein is a headphone comprising an active noise cancellation system as set forth in any of the above embodiments, a casing, a microphone arranged to sense environmental noise connected to the active noise cancellation circuit, and a speaker system connected to the active noise cancellation circuit, the speaker system mounted in the casing.

In an embodiment, the microphone and the active noise cancellation circuit are mounted in the casing.

Also disclosed herein is a method of generating a headphone audio signal including the steps:

- sensing environmental audio noise signal through a microphone;
- converting the sensed environmental audio noise signal to a digital environmental audio noise signal using an Analog-to-Digital Converter (ADC);
- running a prediction filter training algorithm on the digital audio noise signal to extract prediction filter coefficients;
- updating the prediction filter coefficients into a prediction filter working at a multiple N times of said clock frequency fs configured to predict a plurality D of future samples of environmental noise signal;

processing the digital audio noise signal and its predicted plurality D of future samples to generate inverted predicted environmental noise samples; and converting the inverted predicted environmental noise samples to an analog active noise cancellation signal by a Digital-to-Analog Converter (DAC).

In an embodiment, the ADC and DAC work at a clock frequency (fs) having a total latency of less than 1 μs.

In an embodiment, the method further comprises:

adding user intended audio signal samples to the inverted predicted environmental noise samples and converting said samples by the Digital-to-Analog Converter (DAC) to an analog audio signal including the active noise cancellation signal.

In an embodiment, an analog audio signal including the active noise cancellation signal is fed to a speaker system, to play to the user the intended audio signal and at the same time cancelling environment noise.

In an embodiment, the method further comprises:

processing the digital audio noise signal and its predicted plurality D of future samples in a casing frequency response filter to adjust for microphone location.

In an embodiment, the predicted plurality D of future samples has a prediction depth time $T_{PD}$ corresponding to a total latency of an active noise cancellation circuit including the ADC and the DAC.

In an embodiment, the prediction filter is configured to predict said plurality D of future samples of environmental noise signal, so that said plurality divided by said clock frequency D/fs is substantially equal to the prediction time depth $T_{PD}$.

In an embodiment, the prediction filter is operated at a multiple N times higher clock frequency N×fs than the clock frequency fs of the ADC, where the multiple N is in a range of 10 to 1000.

In an embodiment, the number of the predicted noise samples in the anticipated future noise signal is advantageously equal to $T_{PD}$*fs, in which $T_{PD}$ is the total latency of the active noise cancellation system and fs is the clock frequency of the ADC.

In an embodiment, the total latency $T_{PD}$ of the active noise cancellation system is in a range of 100 μs to 200 μs.

In an embodiment, the clock frequency $f_S$ of the ADC is higher than 200 KHz, for instance in a range from 200 kHz to 1 MHz.

Further objects and advantageous features of the invention will be apparent from the claims and the following detailed description of embodiments of the invention in relation to the annexed drawings in which:

Figure 1:
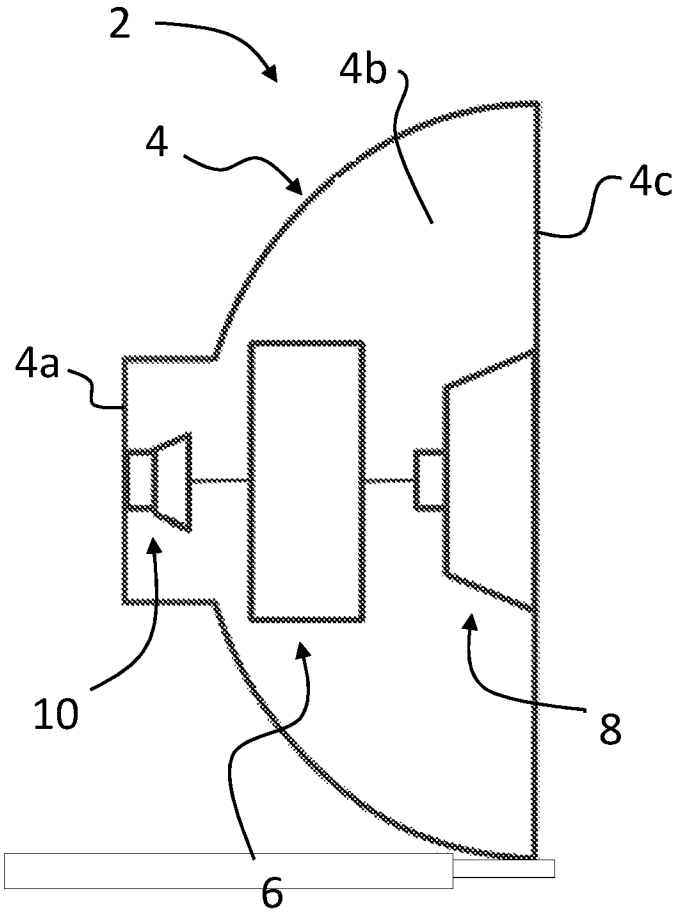
FIG. 1 is a schematic simplified diagram of a headphone according to an embodiment of the invention.

Referring to the figures, a headphone 2 according to embodiments of the invention that is configured to be worn against, in, or close to a person's ear, comprises a casing 4, an active noise cancellation system 6 mounted in the casing 4, and a speaker system 8 mounted in the casing 4. The speaker system 8 may comprise various sound transducers to reproduce sound from an audio signal supplied to the transducer as is per se well known in the art.

The casing 4 comprises an outer side 4*a* corresponding to an external environmental noise receiving side, an ear side 4*c* configured to direct the sound produced by the speaker system 8 towards the person's ear, and an inner portion 4*b* housing components of the the speaker system 8. Components of the active noise cancellation system are preferably also mounted inside the casing 4, however in variants, components of the active noise cancellation system may also be mounted in part or wholly outside of the casing 4 that houses the speaker system, for instance in a separate housing such as in a head strap joining two headphone devices or in a cabled control connected to the headphone device.

The active noise cancellation system 6 comprises a microphone 10 and an active noise cancellation circuit 12. In a preferred embodiment, the microphone may be positioned proximate the outer side 4*a* of the casing configured to capture external (environmental) noise that is to cancelled. In variants however, the microphone may also be positioned within the casing at various positions or outside the casing in a separate support such as a headphone head band.

In an embodiment, the active noise cancellation circuit includes an Analog-to-Digital Converter (ADC) 14, a prediction filter 16, a Digital-to-Analog converter (DAC) 24, a clock 28, and an amplifier circuit 26 connected to the speaker system 8. The active noise cancellation system may further include a casing frequency response filter circuit 22.

The prediction filter 16 comprises a digital prediction filter circuit 20 and a prediction filter coefficients training algorithm 18

Figure 2:
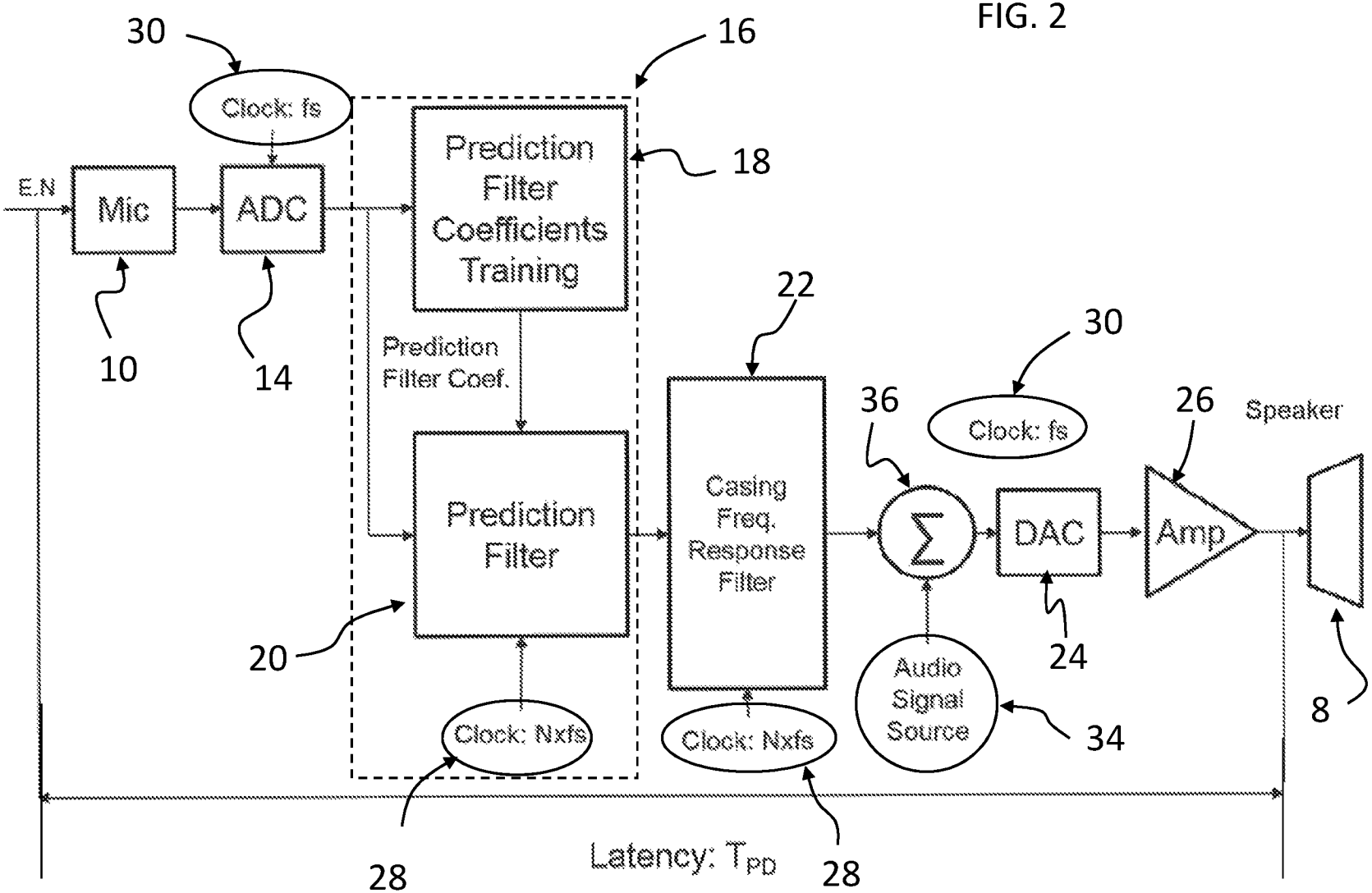
FIG. 2 is a schematic block diagram of an active noise cancellation system according to a first embodiment of the invention.
Figure 3:
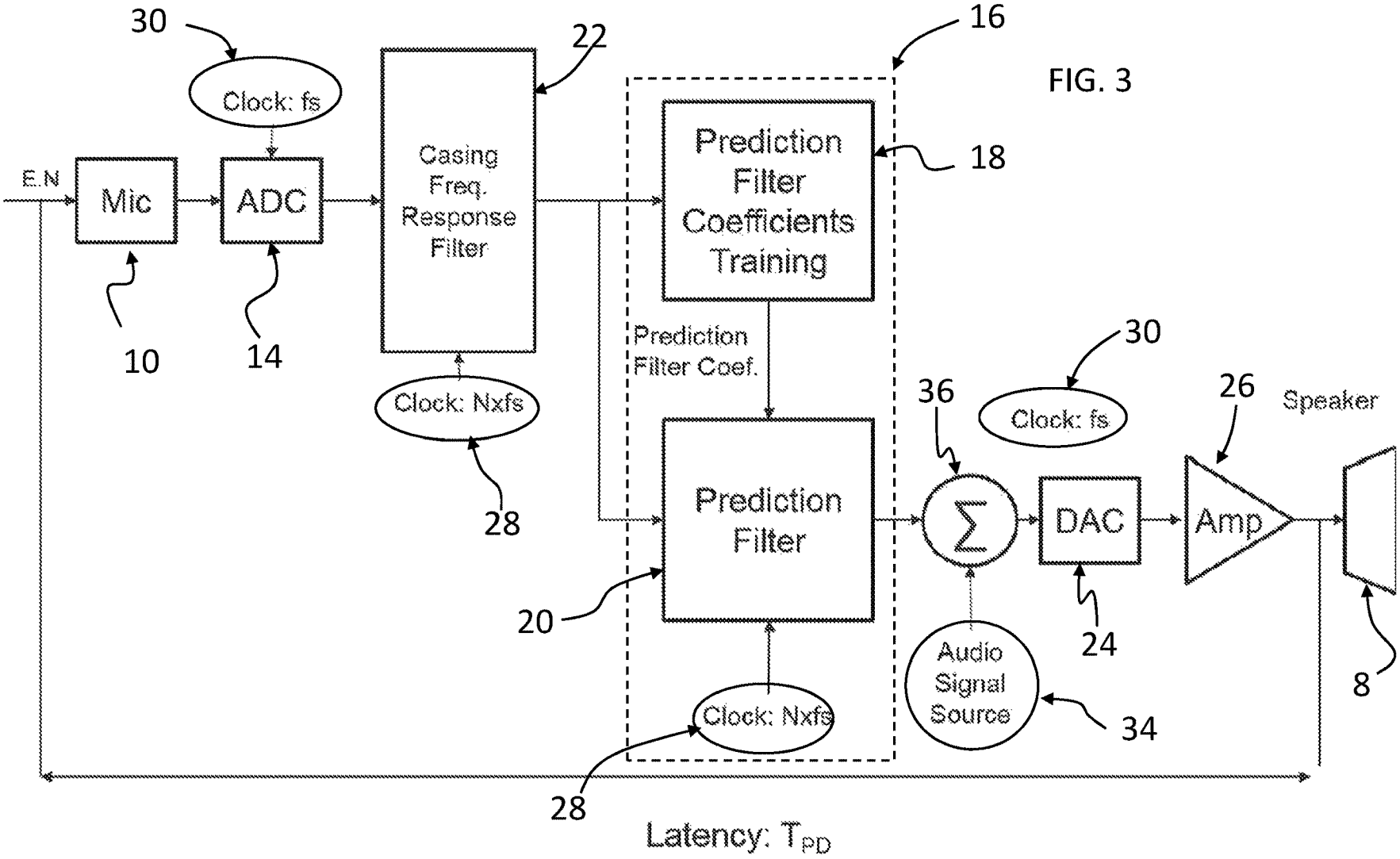
FIG. 3 is a schematic block diagram of an active noise cancellation system according to a second embodiment of the invention.

Referring to FIGS. 2 and 3, exemplary embodiments of an active noise cancellation system of a headphone according to the invention are illustrated schematically. The active noise cancellation system incorporates the microphone 10, analog-to-digital converter 14, prediction filter training algorithm 18 for extracting the optimal coefficients for the prediction filter, a prediction filter 20 for predicting a plurality D of inverted noise samples of the anticipated environmental noise E.N., a digital summing circuit 36, a digital-to-analog converter 24, an amplifier 26 to adjust the noise levels, and a speaker system 8 to play the audio and inverted noise signals. In an advantageous embodiment, the plurality of inverted noise samples D may advantageously be in the range of 10 to 40 samples depending on the sampling frequency. This range of samples facilitates prediction of future environmental noise for a duration of the predicted future environmental noise samples of up to about 200 μs for instance.

The environmental noise E.N. received by the microphone 10 is converted by the transducer of the microphone into an electrical signal that is fed into the Analog-to-Digital Converter (ADC) 14 that converts the analog signal of the environmental noise to a digital signal. It may be noted that the microphone location can be in different positions in or on the headphone, or separate from the headphone, whereby the signal generated by the microphone can be adjusted for its specific location by a transfer function applied by a filter system of the headphone. In other words, the position dependent variation of the microphone transducer output signal can be compensated by a filter system that acts as a transfer function on the microphone output signal. The microphone filter can be applied on the analog signal before the ADC 14 or on the digital signal after the ADC 14.

The Analog-to-Digital converter (ADC) 24 is per se known, but is preferably configured or selected among ADCs having a conversion cycle of less than 1 μs of total latency and preferably a resolution of 14 bits or more.

The digital signal of the E.N. is fed into a prediction filter 16 that stores and executes a training algorithm to extract coefficients of the prediction filter circuit 20. Various generic training algorithms used in various generic prediction filters such as Recursive Least Squares (RLS) filters or Kalman filters can be used for this purpose. Because of the typical natural changes of environment noise in most environments in which users are located, the coefficients of prediction filter may be configured to be updated at discrete time intervals $T_U$ of up to 2 seconds or less, where the time interval $T_U$ is preferably smaller than 1 second.

In a non-limiting example, a prediction filter coefficients training program may comprise a general NLMS (Normalized Least Mean Square) algorithm receiving a digital input signal of microphone and an expected output signal of the prediction filter 20, the expected output signal comprising predicted samples of digital signal. The prediction filter may for instance be a Finite Impulse Response (FIR) filter. The coefficients of the Finite Impulse Response (FIR) filter for the prediction are then generated by the coefficients training algorithm. Typically, 512 coefficients will be enough for proper prediction. These filter coefficients will be used in prediction filter circuit 20. The prediction filter circuit 16 and prediction filter coefficients training program 20 may for instance be implemented and executed in a field-programmable gate array (FPGA) (e.g. Artix 7 Series of Xilinx) to meet the speed and latency requirements of the system.

The digital noise samples from the ADC, along with the prediction filter coefficients are fed into the prediction filter circuit 20. The prediction filter circuit may for instance be based on a Finite Impulse Response (FIR) or Infinite Impulse Response (IIR) general schemes of prediction filters. In embodiments of the invention, the prediction filter is operated at multiple N times higher clock frequency (N×fs) than the clock frequency (fs) of the ADC 14 and DAC 24, because it needs to generate D samples in the future in one clock time (1/fs). Multiple N is preferably greater than 10, for instance in a range of 10 to 1000. The number of the predicted noise samples in the anticipated future noise signal may advantageously be equal to $T_{PD}$*fs, in which $T_{PD}$ is the total latency of the active noise cancellation system (as depicted in FIGS. 2 and 3). Depending on the total delays of all the modules 14, 16, 22, 36, 24 in the digital path, the total latency $T_{PD}$ is preferably in the range of 100 μs to 200 μs. For optimal implementation of a high performance system, the clock frequency $f_S$ is preferably higher than 200 KHz, for instance in a range of values from 200 kHz to 1 MHz.

Digital noise samples and the predicted noise samples may in addition be processed through a casing frequency response filter 22. Casing frequency response filter 22 compensates the effects of the headphone casing 4 on environmental noise signals with respect to the location of microphone 10. The casing frequency response filter allows the microphone to be installed anywhere in the headphone or even the noise environment, and can be calibrated to compensate the difference between the noise signal received by microphone and the noise signal received by the listener's ear using this casing frequency response filter. In embodiments where the microphone is installed inside the headphone such that it receives essentially the same acoustic signal that is generated for the listener's ear, the casing frequency response filter may have a transfer function set to 1, corresponding to no filtering effect or to −1 corresponding to no filter effect but with an inverted signal.

In the embodiment of FIG. 2, the casing frequency response filter outputs the final predicted sample of inverted noise for cancelling the environmental noise from the sound directed to the listener's ear. The inversion of the digital signal for the purpose of cancelling the environmental noise may be performed by the casing frequency response filter.

In a variant as illustrated in FIG. 3, the casing frequency response filter 22 may be positioned before the prediction filter 16, whereby the prediction filter circuit 20 outputs the final predicted sample of inverted noise for cancelling the environmental noise from the sound directed to the listener's ear.

The final predicted sample of noise is added by a summing circuit 36 to the user audio signal sample (e.g. music, speech) received from an audio signal source 34. The output of the summing circuit 36 is processed by the Digital-to-Analog Converter (DAC) 24 working at fs clock frequency into an analog signal. The output of DAC is an analog inverted noise plus user audio signal. The DAC 24, which is per se known, is preferably configured or selected among DAC's having a total conversion latency of less than 1 μs.

The analog inverted noise plus user audio signal may be fed to an amplifier with a fixed gain for adjusting the gain of the analog signal to the speaker system, and the amplified signal may be played through the speaker system 8. The volume control of the audio signal is controlled by a volume control of the audio signal source before adding to the inverted environmental noise signal since the amplitude of the environmental noise to be cancelled is independent of the amplitude of the audio signal played to the user.

The acoustic audio signal of speaker system cancels the instantaneous environmental noise and only the user audio signal from the audio signal source 34 will be heard by the user.

In a variant (not shown), the summing circuit may be an analog summing circuit provided after the DAC arranged to add an analog audio signal to the analog inverted environmental signal output by the DAC.

A method of generating a headphone audio signal according to embodiments of the invention may include the following steps

- sensing acoustic environmental noise signal through a microphone;
- converting the sensed environmental noise signal to a digital environmental noise signal using a low latency and fast Analog-to-Digital Converter (ADC) working at clock frequency of fs, having a total latency of less than 1 μs;
- running a prediction filter training algorithm on the digital environmental noise signal to extract prediction filter coefficients at discrete intervals of $T_{PT}$ seconds, for instance where $T_{PT}$ is in a range of 50 ms to 1 s, for instance around 100 ms;
- updating the prediction filter coefficients into a prediction filter working at a plurality N times the clock frequency $f_S$ (N×fs) to be able to predict a plurality D of future samples of environmental noise signal;
- processing the digital audio noise signal in the prediction filter to predict a plurality D of future digital samples of the noise signal with inverted sign;
- processing the digital audio noise signal and its predicted plurality D of future samples to generate inverted predicted environmental noise samples;
- adding user intended audio signal samples to the inverted predicted environmental noise samples to generate final digital audio samples;
- converting the final digital audio samples to an analog audio signal by a Digital-to-Analog Converter (DAC) working at clock frequency of fs, having a total latency of less than 1 μs.

The analog audio signal may then be amplified by an amplifier to generate an amplified audio signal that is fed to a speaker system, to play to the user the intended audio signal and at the same time cancelling environment noise. It may be noted that the volume control of the audio signal is controlled by a volume control of the audio signal source before adding to the inverted environmental noise signal since the amplitude of the environmental noise to be cancelled is independent of the amplitude of the audio signal played to the user.

The total latency of the digital circuitry including the ADC and the DAC corresponds to a prediction depth time $T_{PD}$. The prediction filter is configured to predict D samples in the future, so that D/fs becomes equal to $T_{PD}$, which allows for the best possible reduction of the environmental noise.

The method may further include processing the digital environmental noise signal through a casing frequency response filter circuit to adjust for the location of the microphone.

The headphone may be a wireless or wired headphone and may further comprise a communication module for communication with an application installed on a user device such as a smart phone, a tablet, or a computer. The communication module may be configured to allow a user to manually change and customize certain parameters of the active noise cancellation system via an application on the user device. The communication may be established in a way that at least some processing can be done using processing power of the user device.

LIST OF REFERENCES

- Headphone 2
- Casing 4
  - Outer side (environmental noise receiving side) 4*a*
  - Inner portion 4*b*
  - Ear (sound generating) side 4*c*
- Active noise cancellation system 6
  - Microphone 10
  - Active noise cancellation circuit 12
    - Analog-to-Digital Converter (ADC) 14
    - Prediction filter 16
      - Prediction filter coefficients training algorithm 18
      - Digital prediction filter circuit 20
    - Casing frequency response filter circuit 22
    - Digital-to-Analog Converter (DAC) 24
    - Amplifier 26
    - Summing circuit 36
    - Clock 28
    - Clock 30
- Speaker system 8
- Audio signal source 34

D: number of predicted future samples of environmental noise signal $T_{PD}$: prediction depth time fs: clock frequency N: multiple of the clock frequency fs at which the prediction filter and casing frequency response filters operate $T_{PT}$: time interval between running a prediction filter training algorithm on the digital environmental noise signal to extract prediction filter coefficients $T_U$: time interval between updating coefficients of the prediction filter

The invention claimed is:

1. An active noise cancellation system comprising an active noise cancellation circuit connected to a microphone, the microphone arranged to sense environmental noise, the active noise cancellation circuit comprising:

an analog-to-digital converter (ADC) arranged to convert the sensed environmental noise to a digital environmental noise signal;

a prediction filter configured for predicting on the digital environmental noise signal a plurality D of inverted digital environmental noise samples and generating a digital inverted environmental noise signal based on the predicted plurality D of inverted digital environmental noise samples; and a digital-to-analog converter (DAC) to convert the digital inverted environmental noise signal to an analog inverted environmental noise signal for cancelling the environmental noise, wherein the predicted plurality (D) of inverted digital environmental noise samples has a prediction depth time $T_{PD}$ corresponding to a total latency of the active noise cancellation circuit including the ADC and the DAC.

2. The active noise cancellation system according to claim 1, wherein the active noise cancellation circuit comprises a casing frequency response filter arranged in a digital signal path before or after the prediction filter, to compensate the effects of location of the microphone on the sensed environmental noise.

3. The active noise cancellation system according to claim 1, wherein the active noise cancellation circuit comprises a summing circuit arranged to add an audio signal intended for playing to a user to the digital or analog inverted environmental noise signal.

4. The active noise cancellation system according to claim 3, wherein the active noise cancellation circuit comprises an amplifier to adjust a gain of the summed audio signal and inverted environmental noise signal.

5. The active noise cancellation system according to claim 1, wherein the ADC and DAC work at a clock frequency (fs) having a total latency of less than 1 μs.

6. A method of generating a headphone audio signal, the method comprising:

sensing an environmental audio noise signal through a microphone;

converting the sensed environmental audio noise signal to a digital environmental audio noise signal using an Analog-to-Digital Converter (ADC);

running a prediction filter training algorithm on the digital environmental audio noise signal to extract prediction filter coefficients;

updating the prediction filter coefficients into a prediction filter working at a multiple N times of said clock frequency (fs), the prediction filter configured to predict a plurality (D) of future samples of environmental noise signal;

processing the digital environmental audio noise signal and its predicted plurality (D) of future samples to generate inverted predicted environmental noise samples; and converting the inverted predicted environmental noise samples to an analog active noise cancellation signal by a Digital-to-Analog Converter (DAC), wherein the predicted plurality (D) of future samples has a prediction depth time $T_{PD}$ corresponding to a total latency of an active noise cancellation circuit including the ADC and the DAC.

7. The method according to claim 3, wherein the ADC works at a clock frequency (fs) having a total latency of less than 1 μs.

8. The method according to claim 6, further comprising: adding user intended audio signal samples to the inverted predicted environmental noise samples and converting said added samples by the Digital-to-Analog Converter (DAC) to an analog audio signal including the active noise cancellation signal.

9. The method according to claim 8, wherein the analog audio signal including the active noise cancellation signal is fed to a speaker system, to play to the user the user intended audio signal samples and at the same time cancelling environment noise.

10. The method according to claim 6, further comprising: processing the digital environmental audio noise signal and its predicted plurality (D) of future samples in a casing frequency response filter to adjust for microphone location.

11. The method according to claim 6, wherein the prediction filter is configured to predict said plurality (D) of future samples of environmental noise signal, so that said plurality divided by said clock frequency (D/fs) is substantially equal to the prediction time depth ($T_{PD}$).

12. The method according to claim 6, wherein the prediction filter is operated at multiple N times higher clock frequency (N×fs) than the clock frequency (fs) of the ADC (14), where the multiple N is in a range of 10 to 1000.

13. The method according to claim 6, wherein the number of the predicted noise samples in an anticipated future noise signal is equal to $T_{PD}$*fs, in which $T_{PD}$ is the total latency of the active noise cancellation system and fs is the clock frequency of the ADC.

14. The method according to claim 6, wherein the total latency $T_{PD}$ of the active noise cancellation system is in a range of 100 μs to 200 μs.

15. The method according to claim 6, wherein the clock frequency (fs) of the ADC is in a range from 200 kHz to 1 MHz.

16. A headphone comprising a casing, a microphone arranged to sense environmental noise, a speaker system mounted in the casing, an active noise cancellation system comprising an active noise cancellation circuit connected to the microphone and to the speaker system, the active noise cancellation circuit comprising:

an analog-to-digital converter (ADC) arranged to convert the sensed environmental noise to a digital environmental noise signal;

a prediction filter configured for predicting on the digital environmental noise signal a plurality D of inverted digital environmental noise samples and generating a digital inverted environmental noise signal based on the predicted plurality D of inverted digital environmental noise samples; and a digital-to-analog converter (DAC) to convert the digital inverted environmental noise signal to an analog inverted environmental noise signal for cancelling the environmental noise, wherein the predicted plurality (D) of inverted digital environmental noise samples has a prediction depth time $T_{PD}$ corresponding to a total latency of the active noise cancellation circuit including the ADC and the DAC.

17. The headphone according to claim 16, wherein the active noise cancellation circuit comprises a casing frequency response filter arranged in the digital signal path before or after the prediction filter, to compensate the effects of location of the microphone on the sensed environmental noise.

18. The headphone according to claim 16, wherein the active noise cancellation circuit comprises a summing circuit arranged to add an audio signal intended for playing to a user to the digital or analog inverted environmental noise signal.

19. The headphone according to claim 18, wherein the active noise cancellation circuit comprises an amplifier to adjust a gain of the summed audio signal and inverted environmental noise signal.

20. The headphone according to claim 16, wherein the ADC and DAC work at a clock frequency (fs) having a total latency of less than 1 μs.

21. The headphone according to claim 16, wherein the microphone and the active noise cancellation circuit are mounted in the casing.

* * * * *